United States Patent [19]

Sadowski

[11] 4,377,118

[45] Mar. 22, 1983

[54] PROCESS FOR REDUCING SLAG BUILD-UP

[75] Inventor: Anthony J. Sadowski, Naperville, Ill.

[73] Assignee: Nalco Chemical Company, Oak Brook, Ill.

[21] Appl. No.: 332,379

[22] Filed: Dec. 21, 1981

[51] Int. Cl.[3] ..... F23B 7/00; C10L 10/04

[52] U.S. Cl. ..... 110/343; 110/244; 110/342; 44/5

[58] Field of Search ..... 44/4, 5; 110/265, 342, 110/343, 244

[56] References Cited

U.S. PATENT DOCUMENTS

| | | | |
|---|---|---|---|
| 1,894,682 | 1/1933 | Haas | 110/342 |
| 3,048,131 | 8/1962 | Hardgrove | 110/344 |
| 3,179,074 | 4/1965 | Clark et al. | 110/265 |
| 3,180,289 | 4/1965 | Steinert | 110/265 |
| 3,332,755 | 7/1967 | Kukin | 44/4 |
| 3,738,819 | 6/1973 | Milner et al. | 44/4 |
| 4,057,398 | 11/1977 | Bennett et al. | 44/4 |
| 4,132,180 | 1/1979 | Fredrick | 110/265 |

*Primary Examiner*—Carl F. Dees

*Attorney, Agent, or Firm*—Joan I. Norek; John G. Premo; Robert A. Miller

[57] ABSTRACT

The present invention provides a method for reducing slag build-up in cyclone furnaces comprising introducing into a cyclone furnace at least one of a slag viscosity modifier and a combustion adjuvant, wherein a substantial portion thereof is conveyed to the walls of the furnace by addition through the secondary air stream. Preferably the additives are formed as particles of sufficient size and density that they are driven directly to the walls of the furnace. This method alleviates slag build-up caused by the presence of uncombusted coal particles at the walls and increases the temperature environment at the walls.

5 Claims, No Drawings

PROCESS FOR REDUCING SLAG BUILD-UP

TECHNICAL FIELD OF THE INVENTION

The present invention is in the technical field of processes and methods for reducing or eliminating slag build-up on furnace walls, particularly wet bottom utility cyclone furnaces which are coal fired.

BACKGROUND OF THE INVENTION

Cyclone furnaces or burners are often the firing units of boilers. A cyclone furnace is formed with a horizontally disposed tube, or furnace box, into which the fuel is introduced at one end, and the combustion gases are expelled at the opposite end. These combustion gases rise, transferring their heat to water or steam flowing in the boiler tubes above to convert the water to steam or to superheat the steam. From the steam, power such as electricity is produced.

In a cyclone furnace the air required to combust the fuel is added in three modes. For coal fired cyclone furnaces, crushed coal is conveyed into the furnace with the first or primary air stream, the first mode of adding air. The primary air stream generally comprises about 15 to about 20 percent of the total required air. A major proportion of the required air, about 65 to about 80 percent, is introduced into the furnace in a secondary air stream, a high speed stream added tangentially to the furnace tube or box at its circumference. About 5 percent of the required air is introduced as a tertiary air stream which fine tunes the total amount of air being added to the furnace.

The tangentially added secondary air stream creates a rotating air movement within the furnace box wherein the air whirls inward toward a center of minimum pressure, resembling a horizontal cyclone. The crushed coal being fed then moves through the center of this whirling air formation, from the box end where it was added with the primary air stream, to a flame where it is combusted. The hot gases of combustion, which are mainly carbon dioxide and water vapor, are emitted at the far end past the flame.

The nongaseous combustion products of coal are coal ash or slag. Such slag is generally composed of compounds of silicon, aluminum, iron, calcium, and possibly some titanium, phosphorus, and the alkali metals. The chemical composition may vary over a wide range, particularly with respect to the compounds of silicon, aluminum, and iron, depending upon the source of the coal. Even coal derived from different seams in the same geographic region can have slags or coal ash of significantly varied compositions.

All coal ashes, when heated to a sufficiently high temperature, will form a liquid slag whose viscosity varies inversely with temperature. It is generally believed in the art that chemical reactions occur in the ash during liquid slag formation, and that the viscosity patterns of the slag so formed are dependent on both the ultimate composition of the slag and the state of oxidation of the iron therein.

When coal is combusted in a cyclone furnace, about 10–15 percent of the combustion product will be coal ash. This percentage can vary from about 5 to about 35 percent for some unusual coals. A substantial portion of this is slag driven by the centrifugal force created by the secondary air stream to the furnace wall. For some cyclone furnace, about 85 percent of the slag formed will go to the walls, the remainder leaving the furnace with the combustion gases, and fly ash.

Wet bottom cylcone furnaces are designed for removal of the slag in its molten state, and have drain holes at the bottom of the box. For a given slag, however, there is a temperature at or below which the slag will not effectively flow down the walls of the furnace to and through the slag drain holes under the low shear forces of gravitation. This temperature is generally called the temperature of critical viscosity. Further, at an even lower temperature, the slag freezes to a solid. Related to these temperature is a number of temperatures discussed below, which can be easily determined in a laboratory, and it is recognized in the art that a change in the laboratory determined temperatures is indicative of a similar change in the freezing temperature and temperature of critical viscosity of a given slag.

Thus the viscosity pattern of a given slag is temperature dependent, and dependent on the ultimate composition of the slag which in turn depends on the composition of the coal being combusted and probably to an extent on the combustion conditions.

Thus a wet bottom cylcone furnace may have been designed for effective removal of slag having a given temperature necessary for effective flow and that furnace under operating conditions creates at least such minimum temperature environment at its walls. But due to changes or fluctuations in coal composition, or the need to burn less expensive coal, the wall temperature environment is not sufficient for the coal actually being combusted. The slag does not flow effectively. Even the drain holes become clogged.

This slagging problem is further complicated when coal particles, generally those of larger than desired size, escape combustion in the flame and are driven to the furnace walls with the slag, forming a matrix with the molten slag and thus disrupting the slag flow. It is believed that the presence of such coal particles at the furnace walls will significantly reduce or stop effective slag flow even though the temperature environment at the walls would otherwise be sufficient for the slag being produced.

Moreover, when slag flow slows down or stops, that slag will be covered with layers of more slag, forming not only a thicker build-up, but reducing the temperature environment of the slag below the outermost layer. Heat transfer through slag is low, slag being considered generally an insulating material. Thus a condition that began as a slowing up of the slag flow may easily become one of frozen slag build-up due to the significant drop of the temperature gradient from the outermost slag layer through to the furnace walls.

Thus the disruption of slag flow by the presence of uncombusted coal particles at the furnace walls, even when the coal being combusted is compatible with the design of the particular wet bottom furnace, can lead to a serious slag build-up problem.

When slag builds up on furnace walls, it distorts the burner's flame configuration, and the greater the build up, the greater the distortion until the furnace is required to be shut down. Utility boilers are generally fired by a plurality of cylcone furnaces and require a given minimum of these for operation. If a sufficient number of furnaces are shut down, the boiler itself must be shut down. Thus furnace slagging problems not only create expensive maintenance costs in the cleaning of slagged over furnaces, but the lead to the expense of lost production time and the expense of purchasing the product, such as electricity, from other producers to meet the needs normally served.

Chemical slag modifiers are well known in the art. For wet bottom furnaces, suitable slag viscosity modifiers reduce the fusion point of slag to achieve the necessary slag viscosity in the temperature environment present at the furnace walls. Such slag viscosity modifiers, for example, include without limitation sodium sulfate, sodium carbonate, borate salts of ammonium, lithium, magnesium, potassium and sodium, and other alkaline salts, and minerals such as dolomite, colemanite, limestone, and ulexite.

To reduce the number of coal particles that escape the flame uncombusted, it is well known in the art to add a combustion catalyst or adjuvant, such as salts of copper, iron, cobalt, managanese, and the like.

Further it has been the general practice to feed such slag modifiers and combustion catalysts to the furnace as part of the coal feed, as intimate mixtures with the pulverized coal. Such additives are generally introduced into the furnace on a continuous basis at levels generally within the range of from about 0.1 up to even 100 pounds per ton of coal being fed to the furnace.

A portion of slag viscosity modifiers added with the coal feed is presumed to become intimately mixed with the slag as it is formed in the flame area, and be driven to the furnace walls with the slag. Combustion adjuvants when added to the coal feed presumably are present in the flame to promote combustion of the larger particles in the coal feed. A significant portion of both, however, becomes entrained in the combustion gases and is removed from the furnace box, never reaching the furnace walls. The additives, when added to the coal feed, thus do little to aleviate slag build up that is caused by the intermingling of uncombusted coal particles with the slag, other than to reduce the number of such particles, but in practice the additives do not reduce the coal particles to zero.

These additives add significantly to the cost of producing electricity or other power when used at typical levels. Further, at desired use levels, some of the additives have deleterious effects, such as the sodium compounds which create corrosion problems, limiting the use of sodium compounds although they are well recognized as extremely effective fusion point modifiers. As mentioned above, even if the slag is properly modified by the viscosity modifiers added with the coal feed, if the combustion adjuvants do not reach the furnace walls, viscosity problems due to the presence of uncombusted coal particles will result.

DISCLOSURE OF THE INVENTION

The present invention provides a process or method for at least reducing slag build-up in cylcone furnaces comprising introducing thereinto a slag viscosity modifier and/or combustion adjuvant, wherein substantial portions thereof are conveyed to the walls of the furnace, escaping the flame and entrainment in the combustion gases that are being expelled from the furnace box. The method preferably involves feeding the slag viscosity modifier and combustion adjuvant directly to the secondary air stream. Such slag viscosity adjuvants are preferably formed as particles of sufficient size and density to be driven to the furnace walls by the centrifugal force created by the rotating motion of the secondary air stream.

It is also preferred that at least one of the components be fluid at the operating temperature of the cyclone furnace in the area of the walls so as to promote homogeneous mixing with the slag/coal matrix. It is also preferred to promote uniform coating of the slag/coal matrix by the additives through additions at intermittent intervals of sufficient periodicity.

PREFERRED EMBODIMENTS OF THE INVENTION

Introducing a slag viscosity modifier and/or combustion adjuvant to a cyclone furnace wherein a substantial proportion of the additive is conveyed to the walls of the furnace is particularly advantageous when the intermingling of uncombusted coal particles with the slag at the furnace walls creates additional slag build-up problems. The combustion adjuvant is present where it is needed, promoting combustion of these coal particles at the wall temperature environment. As mentioned above, if the combustion adjuvant were added to the coal feed, most would escape with the combustion gases.

Coal particles that escape combustion in the flame are a very small fraction of the total coal fed to the cyclone furnace. Addition of a combustion adjuvant to the coal feed may reduce the number of uncombusted coal particles, but seldom will completely eliminate them.

In the process of the present invention, the combustion adjuvant is applied directly and substantially solely to the coal particles that are increasing or causing the slag problem. The effective level of adjuvant required is thus drastically reduced. For instance if a level of 2 pounds of adjuvant per ton of coal feed is effective to reduce the number of uncombusted coal particles in a given situation, 2 pounds of adjuvant per uncombusted material driven to the walls will be more than adequate to promote combustion of the coal particles present in that material. Presuming a typical level of about 15–20 precent nongaseous by-products in the form of slag, uncombusted coal, and fly ash, the level of combustion adjuvant required is reduced by 80 to 85 percent, at a tremendous cost savings, and providing a solution to slagging problems not provided when the adjuvant is added to the feed.

Further, when the combustion of the coal particles at the wall is better promoted with the aid of the combustion adjuvant added directly, thereto, that burning will itself increase the temperature environment at the wall area, reducing slag viscosity.

Similar considerations apply to the addition of the slag viscosity modifier. No substantial portion of the modifier is lost with the combustion gases, and thus the overall level of modifier required is drastically reduced.

Such reduction in use level of the additives permits the use of additives that would have prohibitive deleterious effects at higher use levels, for instance, sodium compounds that cause corrosion problems at normal modifier levels.

The slag viscosity modifier and combustion adjuvant can be added separately, but it is preferred to promote homogeneous mixing with the matrix or uniform coating of the matrix that they be added as an admixture. As mentioned above, to promote homogeneous mixing one or both preferably is formed so as to be fluid at the wall temperature environment, either being molten themselves or solubilized or plasticized in suitable medium.

To assure that most of the additive is driven to the furnace walls when added with the secondary air stream, the additive should be formed a particles of sufficient density and size so as not to drift and be caught up by the escaping combustion gases. The size and density requirements will of course depend on and vary with the particular air flow in the cyclone furnace and with the dimensions of the furnace and can be determined by aeronautical calculations or routine experiments. It is believed that for most furnaces, small pellets of additive would be sufficiently large, while a dust of additive would be of inadequate size.

Given that additives used in the present invention are being added, when not fluid, at a size larger than a fine dust, it is preferable, to provide uniform coating of the matrix, to feed the additives intermittently, at adequate periods, if at the use level continuous feeding will not coat uniformly.

The proportion of combustion adjuvant used in the present invention will of course vary with the various cyclone furnaces, the coal being combusted, the operating conditions, and the problems attendant thereon. Thus the additive may be 100 percent combustion adjuvant in some instances, or 100 percent viscosity modifier in other instances, while proportions of 20 to 80 percent combustion adjuvant, the remainder being viscosity modifier is considered preferred. It has been found, however, that admixtures of about 40 to about 60 weight percent combustion adjuvant with the modifier perform at least as well as viscosity modifiers alone in some instances, when screened by ASTM D 1857-68 test, a test which determines various melting stages of coal ash. Thus such ratio is considered even more preferred.

The ASTM D 1857-68 test provides a practical method of determining in the laboratory the change of fusion points of ash, and the effect thereon of various additives. In this test, coal ash is formed into standard size cones and controlled heated in a controlled atmosphere furnace. The cones go through four melting stages; the temperatures at which the stages occur are indicative of fusion points. These stages are as follows: the first rounding of the apex of the cone occurs at initial deformation temperature (IT); cone fuses down to a spherical lump at softening temperature (ST); the cone fuses down to hemispherical lump at hemispherical temperature (HT); and the fused mass spreads out in a nearly flat layer at fluid temperature (FT).

Combination additives containing about 40 to about 50 percent combustion adjuvant, and added at a dosage level of 2 pounds per ton of coal ash can reduce the initial deformation temperature by about 275° Farenheit, and the fluid temperature by about 170° Farenheit in coal ash from Black Butte coal which otherwise has an IDT of 2115° F. and an FT of 2310° F.

Another indicator of slag viscosity pattern is the "$T_{250}$" of a given slag, which is the temperature at which the viscosity of the slag is 250 poises. This characteristic is determined by simultaneously measuring the temperature and viscosity of the slag.

INDUSTRIAL APPLICABILITY OF THE INVENTION

The present invention is applicable to the power industries, particularly in the generation of power using coal fired cyclone furnaces.

The above described particular embodiments of the invention, methods of operation, materials utilized, and combination of elements and components can vary without changing the spirit of the invention, as particularly defined in the following claims.

I claim:

1. A method for reducing slag build-up in a cyclone furnace comprising:

introducing into a cyclone furnace at least one of a slag viscosity modifier and a combustion adjuvant together with the secondary air stream, wherein said slag viscosity modifier and combustion adjuvant are formed as particles of sufficient size and density so as to be substantially conveyed to the wall of said cyclone furnace by centrifugal force without passing into the combustion site of said cyclone furnace.

2. The method of claim 1 wherein at least one of said slag viscosity modifier and said combustion adjuvant are fluid at the operating temperature in the area of said wall of said cyclone furnace.

3. The method of claim 1 wherein said slag viscosity modifier and said combustion adjuvant are introduced into said cyclone furnace at intermittent intervals.

4. The method of claim 1 wherein from about 20 to about 80 weight percent of the total slag viscosity modifier and combustion adjuvant used is combustion adjuvant.

5. The method of claim 1 wherein from about 40 to about 60 weight percent of the total slag viscosity modifier and combustion adjuvant used is combustion adjuvant.

* * * * *